US008544375B2

(12) United States Patent
Kravitz

(10) Patent No.: US 8,544,375 B2
(45) Date of Patent: Oct. 1, 2013

(54) SYSTEM AND METHOD FOR PROVIDING A COOPERATIVE NETWORK FOR APPLYING COUNTERMEASURES TO AIRBORNE THREATS

(75) Inventor: Arnold Kravitz, Hollis, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 1655 days.

(21) Appl. No.: 10/590,830

(22) PCT Filed: Dec. 23, 2004

(86) PCT No.: PCT/US2004/043733

§ 371 (c)(1),
(2), (4) Date: Aug. 28, 2006

(87) PCT Pub. No.: WO2006/041504

PCT Pub. Date: Apr. 20, 2006

(65) Prior Publication Data

US 2007/0163430 A1 Jul. 19, 2007

Related U.S. Application Data

(60) Provisional application No. 60/578,747, filed on Jun. 10, 2004.

(51) Int. Cl.
*F41H 11/02* (2006.01)

(52) U.S. Cl.
USPC ..... 89/1.11

(58) Field of Classification Search
USPC ..... 89/1.11
See application file for complete search history.

(56) References Cited

U.S. PATENT DOCUMENTS

| | | | | |
|---|---|---|---|---|
| 5,992,288 | A * | 11/1999 | Barnes | 89/1.11 |
| 6,467,388 | B1 * | 10/2002 | Malakatas | 89/41.03 |
| 6,980,152 | B2 * | 12/2005 | Steadman et al. | 342/14 |
| 2003/0033059 | A1 * | 2/2003 | Ebert et al. | 701/3 |

* cited by examiner

*Primary Examiner* — Stephen M Johnson

(74) *Attorney, Agent, or Firm* — Hayes Soloway P.C.; Todd A. Sullivan; Daniel J. Long

(57) ABSTRACT

A system and method capable of providing a cooperative network for applying countermeasures to airborne threats is provided. The system contains at least one aircraft having an airborne countermeasures system (ACS) capable of controlling deployment of countermeasures located on the aircraft. The system also contains a central countermeasures management system (CCMS) capable of communicating with the ACS to control the ACS in deployment of the countermeasures located on the aircraft. The aircraft may be one of a series of aircrafts, where each aircraft within the series of aircrafts has a separate ACS thereon, and where each separate ACS is capable of controlling deployment of countermeasures located on an aircraft within the series of aircrafts on which the separate ACS is located. When multiple aircrafts are within the network, the CCMS is capable of communicating with each separate ACS in response to the airborne threat, to control deployment of the countermeasures.

16 Claims, 5 Drawing Sheets

SYSTEM AND METHOD FOR PROVIDING A COOPERATIVE NETWORK FOR APPLYING COUNTERMEASURES TO AIRBORNE THREATS

CROSS-REFERENCE TO RELATED APPLICATION

This application claims priority to copending U.S. Provisional Application entitled, "Cooperative Network Centric Counter Manpads Airborne Countermeasures System," having Ser. No. 60/578,747, filed Jun. 10, 2004, which is entirely incorporated herein by reference.

FIELD OF THE INVENTION

The present invention is generally related to countermeasures for protecting aircraft from missile threats. More particularly the present invention relates to a cooperative network for protecting aircrafts from missile threats.

BACKGROUND OF THE INVENTION

Recently, there has been an increased interest in improving protection of commercial aircraft. One specific area of increased interest with regard to protection of commercial aircraft is protection of commercial aircraft from ground to air missiles. Examples of ground to air missile systems of specific concern are Man Portable Air Defense Systems (MANPADS), which are man-portable surface to air missiles. MANPADS pose a serious threat to aircraft in general due to their portability, compared to more stationary missile systems that are larger and require transportation via a vehicle, thereby making them easier to detect, and therefore, easier to protect against.

MANPADS defense systems have been mounted on commercial aircraft for the purpose of defending against MANPADS. Unfortunately, MANPADS defense systems have certain limitations. As an example, MANPADS defense systems have limitations as to how many missiles they are capable of defending an associated aircraft from at one time. Therefore, if multiple missiles are launched at the same time or near the same time, the MANPADS defense system may fail to protect the associated aircraft.

Another limitation of MANPADS defense systems becomes apparent in areas with multiple aircrafts flying in a confined area, such as in airports. Since there may be many aircrafts having MANPADS defense systems departing or arriving at an airport at the same time, an attack on one aircraft among the many may cause multiple MANPADS defense systems to attempt to defend against a single missile at the same time. Unfortunately, multiple MANPADS defense systems detecting a missile and acting at the same time in close vicinity of each other may cause interference between the MANPADS defense systems, thereby limiting their defensive capabilities and placing the target of the missile in great danger.

Thus, a heretofore unaddressed need exists in the industry to address the aforementioned deficiencies and inadequacies.

SUMMARY OF THE INVENTION

Embodiments of the present invention provide a system and method for providing a cooperative countermeasure network to counter missile threats. Briefly described, in architecture, one embodiment of the network, among others, can be implemented as follows. The system contains at least one aircraft having an airborne countermeasures system (ACS) capable of controlling deployment of countermeasures located on the aircraft. The system also contains a central countermeasures management system (CCMS) capable of communicating with the ACS to control the ACS in deployment of the countermeasures located on the aircraft.

The present invention can also be viewed as providing methods for providing countering an airborne threat to an aircraft. A first method for providing countering an airborne threat to an aircraft, comprises the steps of: receiving threat information about the airborne threat from a remote source; receiving source information about the remote source; determining a type of airborne threat from the received threat information and the received source information; selecting a countermeasure that is presently available by the remote source, wherein the countermeasure is capable of deterring the airborne threat from inflicting damage to the aircraft; and instructing the remote source to deploy the selected countermeasure that is presently available.

A second method for providing countering an airborne threat to an aircraft, comprises the steps of: determining threat information about the airborne threat; transmitting the threat information to a remote device; transmitting source information to the remote device; receiving instructions to deploy a countermeasure selected by the remote device, as a result of the steps of determining threat information, transmitting the threat information, and transmitting the source information, wherein the selected countermeasure is presently available; and deploying the selected countermeasure, wherein the threat information and the source information is collectively referred to as a track file.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
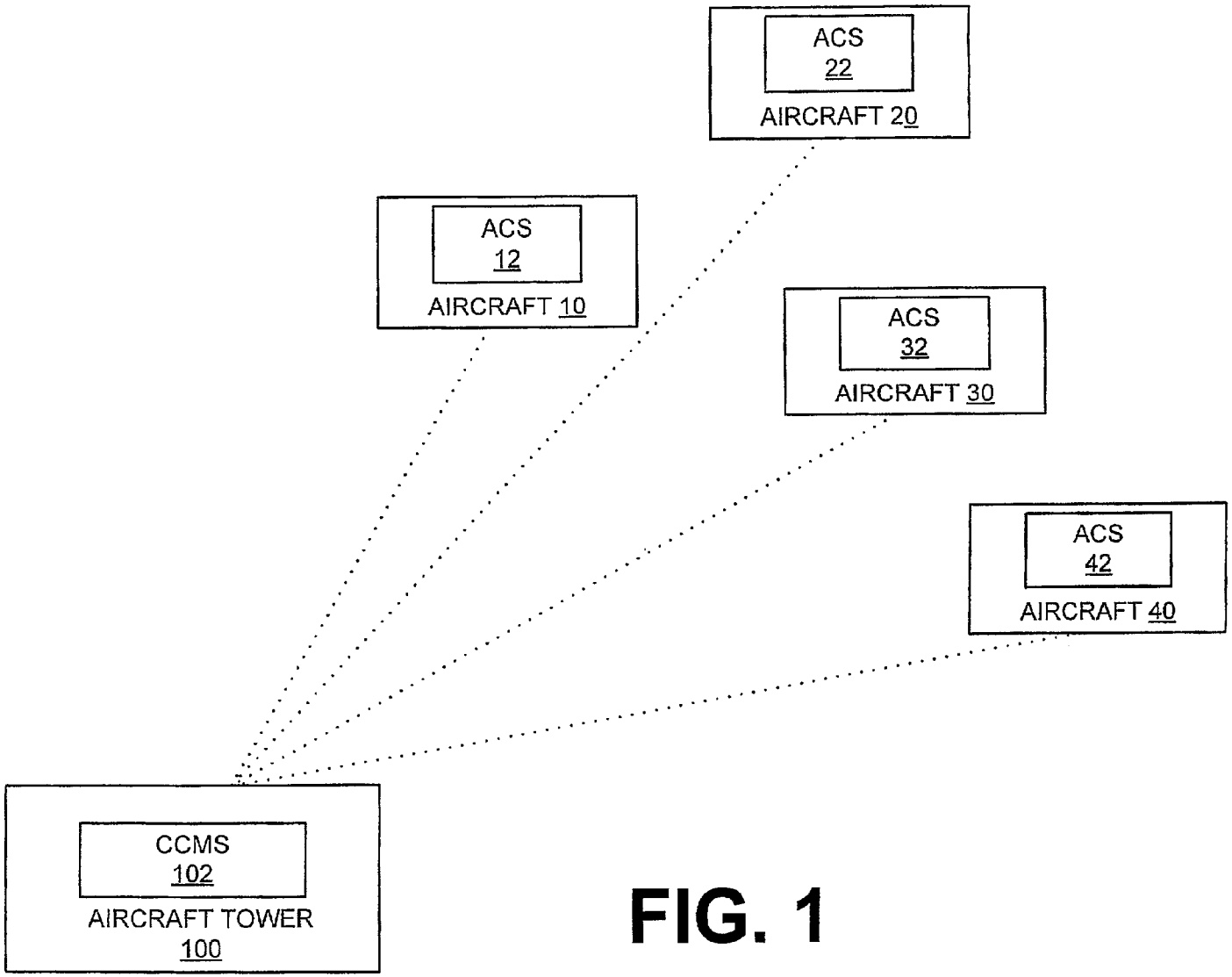
FIG. 1 illustrates an environment that is capable of utilizing the present cooperative countermeasure network.

The present system and method provides a cooperative countermeasure network to counter missile threats. To provide the present network information detected by multiple aircrafts is transmitted to a base station for analysis, countermeasure determination, and assignment of countermeasure deployment. A general view of communication within the present cooperative countermeasure network is provided by FIG. 1. Specifically, FIG. 1 illustrates an environment that is capable of utilizing the present cooperative countermeasure network, wherein multiple aircrafts 10, 20, 30, 40 are located near an aircraft tower 100. Each aircraft 10, 20, 30, 40 has therein an airborne countermeasures system (ACS) 12, 22, 32, 42 that is capable of communicating with a central countermeasures management system (CCMS) 102 located within the aircraft tower 100. Communication between the ACS 12, 22, 32, 42 of each aircraft 10, 20, 30, 40 and the CCMS 102 of the tower 100 may be provided via numerous methods such as, but not limited to, use of a high speed, high bandwidth data communication link between the ACS 12, 22, 32, 42 and the CCMS 102 via radio frequency (RF) communication.

Although FIG. 1 illustrates use of the cooperative countermeasure network within an airport setting, one having ordinary skill in the art will appreciate that the present network may be used outside of an airport setting. As an example, a CCMS 102 may instead be provided within a portable mechanism that may be transported to a remote location where numerous aircrafts are landing and departing. In such an environment, the CCMS 102 would still be capable of communicating with the ACS 12, 22, 32, 42 of each aircraft 10, 20, 30, 40 landing and departing at the location of the CCMS 102. As long as communication between the CCMS 102 and each ACS 12, 22, 32, 42 is made possible, the present cooperative countermeasure network may be provided at any location.

Figure 2:
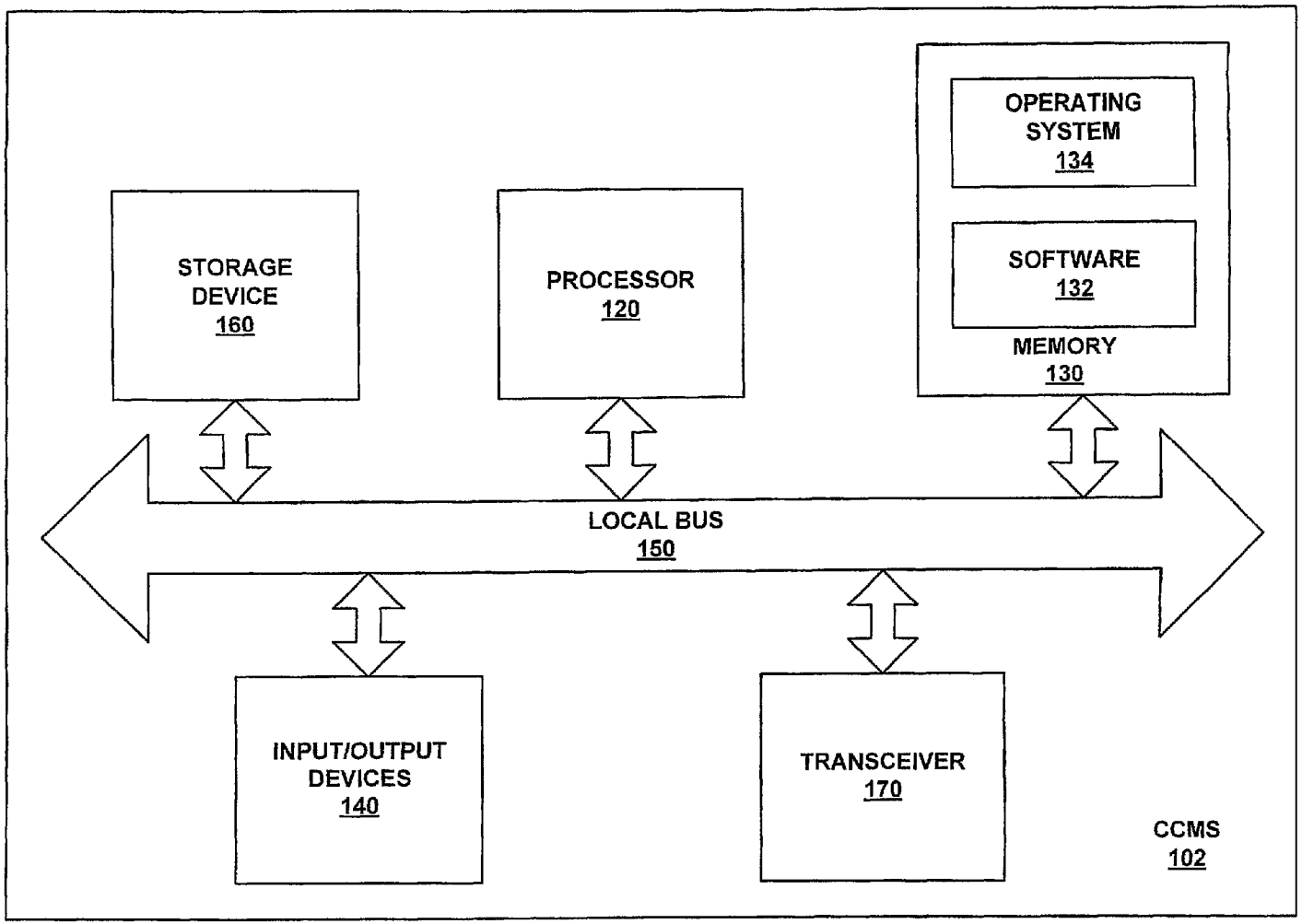
FIG. 2 is a block diagram further illustrating the CCMS of FIG. 1.

FIG. 2 is a block diagram further illustrating the CCMS 102 of FIG. 1. The CCMS 102 can be implemented in software (e.g., firmware), hardware, or a combination thereof. In the currently contemplated best mode, the CCMS 102 is implemented partially in hardware and partially in software, as an executable program, and is executed by a special or general purpose digital computer, such as a personal computer (PC; IBM-compatible, Apple-compatible, or otherwise), workstation, minicomputer, or mainframe computer. FIG. 2 illustrates the CCMS 102 as a general purpose computer that can perform functions of the CCMS 102 as defined herein.

Generally, in terms of hardware architecture, as shown in FIG. 2, the CCMS 102 includes a processor 120, a memory 130, and one or more input and/or output (I/O) devices 140 (or peripherals) that are communicatively coupled via a local interface 150. The local interface 150 can be, for example but not limited to, one or more buses or other wired or wireless connections, as is known in the art. The local interface 150 may have additional elements, which are omitted for simplicity, such as controllers, buffers (caches), drivers, repeaters, and receivers, to enable communications. Further, the local interface 150 may include address, control, and/or data connections to enable appropriate communications among the aforementioned components.

The CCMS 102 also contains a storage device 160 for storing data therein. As an example, in accordance with the first exemplary embodiment of the invention, the data may include threat characteristics, countermeasures and effectiveness against such threats, local ACSs 12, 22, 32, 42 and their available countermeasures, and local countermeasures made available by sources other than the ACSs 12, 22, 32, 42. Further discussion of this data, in addition to the process of using such data, is provided herein.

The processor 120 is a hardware device for executing software 132, particularly that stored in the memory 130. The processor 120 can be any custom made or commercially available processor, a central processing unit (CPU), an auxiliary processor among several processors associated with the computer, a semiconductor based microprocessor (in the form of a microchip or chip set), a macroprocessor, or generally any device for executing software instructions. Examples of suitable commercially available microprocessors are as follows: a PA-RISC series microprocessor from Hewlett-Packard Company, an 80x86 or Pentium series microprocessor from Intel Corporation, a PowerPC microprocessor from IBM, a Sparc microprocessor from Sun Microsystems, Inc, or a 68xxx series microprocessor from Motorola Corporation.

The memory 130 can include any one or combination of volatile memory elements (e.g., random access memory (RAM, such as DRAM, SRAM, SDRAM, etc.)) and nonvolatile memory elements (e.g., ROM, hard drive, tape, CDROM, etc.). Moreover, the memory 130 may incorporate electronic, magnetic, optical, and/or other types of storage media. Note that the memory 130 can have a distributed architecture, where various components are situated remote from one another, but can be accessed by the processor 120.

The software 132 in the memory 130 may include one or more separate programs, each of which comprises an ordered listing of executable instructions for implementing logical functions. In the example of FIG. 2, the software 132 in the memory 130 defines the functionality performed by the CCMS 102 in accordance with the network. A suitable operating system (O/S) 134 may also be stored within the memory 130. A nonexhaustive list of examples of suitable commercially available operating systems 134 is as follows: (a) a Windows operating system available from Microsoft Corporation; (b) a Netware operating system available from Novell, Inc.; (c) a Macintosh operating system available from Apple Computer, Inc.; (d) a UNIX operating system, which is available for purchase from many vendors, such as the Hewlett-Packard Company, Sun Microsystems, Inc., and AT&T Corporation; (e) a LINUX operating system, which is freeware that is readily available on the Internet; (f) a run time Vxworks operating system from WindRiver Systems, Inc.; or (g) an appliance-based operating system, such as that implemented in handheld computers or personal data assistants (PDAs) (e.g., PalmOS available from Palm Computing, Inc., and Windows CE available from Microsoft Corporation). The operating system 134 essentially controls the execution of other computer programs, such as that defined by the software 132 of the CCMS 102, and provides scheduling, input-output control, file and data management, memory management, and communication control and related services.

The I/O devices 140 may include input devices, for example but not limited to, a keyboard, mouse, scanner, microphone, or other input devices. Furthermore, the I/O devices 140 may also include output devices, for example but not limited to, a printer, display, or other output devices. Finally, the I/O devices 140 may further include devices that communicate both inputs and outputs, for example but not limited to, a modulator/demodulator (modem; for accessing another device, system, or network), a radio frequency (RF) or other transceiver, a telephonic interface, a bridge, a router, or other communication devices.

The CCMS 102 also contains a transceiver 170 that is capable of transmitting and receiving signals from an ACS 12, 22, 32, 42. In accordance with the first exemplary embodiment of the invention, the transceiver 170 is capable of high speed, high bandwidth data communication.

When the CCMS 102 is in operation, the processor 120 is configured to execute the software 132 stored within the memory 130, to communicate data to and from the memory 130, and to generally control operations of the CCMS 102 pursuant to the software 132, as defined herein. The software 132 and the O/S 134, in whole or in part, but typically the latter, are read by the processor 120, perhaps buffered within the processor 120, and then executed.

When the CCMS 102 is implemented in software, it should be noted that the CCMS 102 can be stored on any computer readable medium for use by or in connection with any computer related system or method. In the context of this document, a computer readable medium is an electronic, magnetic, optical, or other physical device or means that can contain or store a computer program for use by or in connection with a computer related system or method. The CCMS 102 can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device. The computer readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In an alternative embodiment, where the CCMS 102 is implemented in hardware, the CCMS 102 can be implemented with any or a combination of the following technologies, which are each well known in the art: a discrete logic circuit(s) having logic gates for implementing logic functions upon data signals; an application specific integrated circuit (ASIC) having appropriate combinational logic gates; a programmable gate array(s) (PGA); and a field programmable gate array (FPGA), among others.

Figure 3:
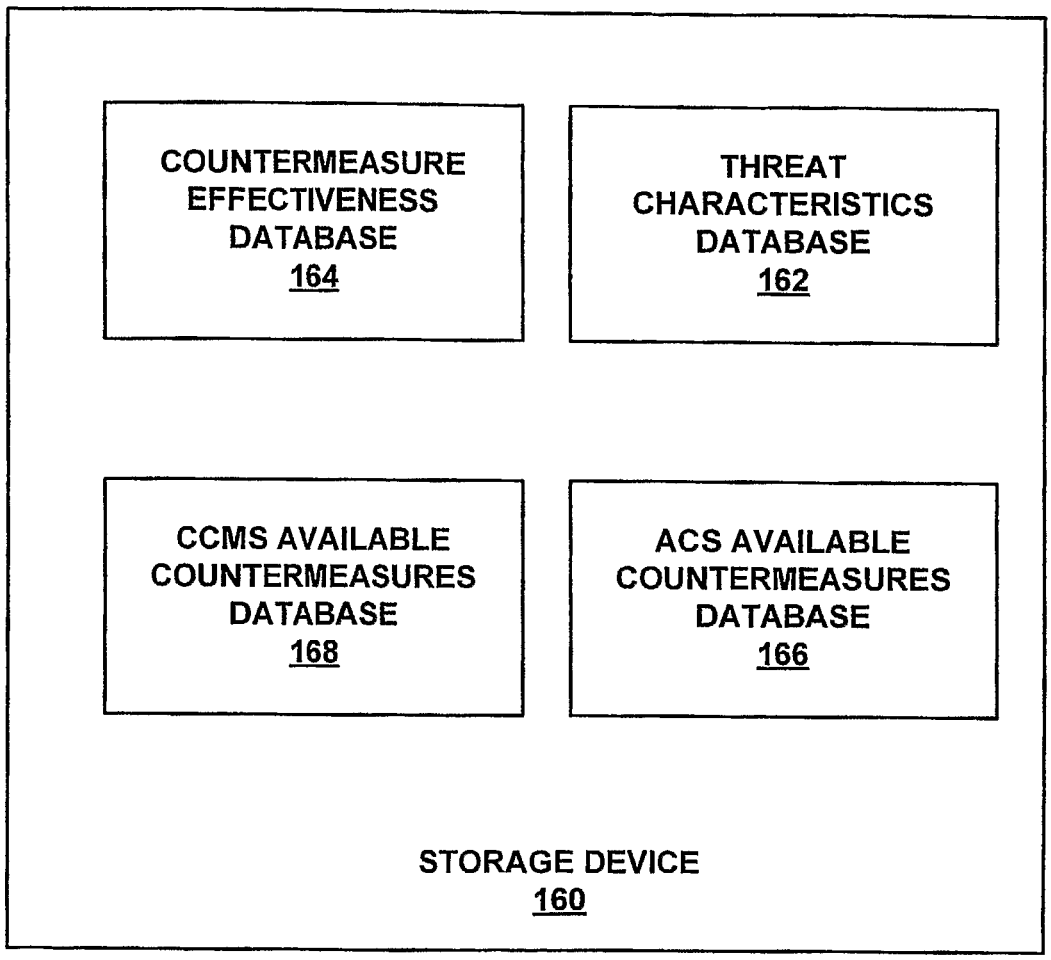
FIG. 3 is a block diagram further illustrating the storage device of FIG. 2.

FIG. 3 is a block diagram further illustrating the storage device 160 of FIG. 2. Specifically, different databases may be located within the storage device 160 for storing specific categories of data. As is shown by FIG. 3, the storage device 160 has a threat characteristics database 162. The threat characteristics database 162 stores characteristics associated with different known types of missile threats. As an example, the threat characteristics database 162 may have stored therein under an identification of a missile type 1: missile plume temperature; missile plume brightness; speed of the missile; spatial associations of the missile (how the threat detections would appear to the sensors spatially, (examples include MTF, size and shape factors)); and threat severity. A prioritization rating is also stored with each type of missile threat. The higher the prioritization rating of the missile threat, the more urgent it is to address the high rated missile threat. As an example, a missile threat that is known to be strong enough to completely destroy an aircraft (i.e., high lethality), and that has a high probability of hitting its target, would be given a higher rating of prioritization than a missile threat that is only capable of causing slight damage to the aircraft. Of course, other characteristics of each known type of missile threat may be stored within the threat characteristics database 162.

The storage device 160 also contains a countermeasure effectiveness database 164. The countermeasure effectiveness database 164 has stored therein different known countermeasures that are capable of defending a targeted aircraft against different known types of missile threats. Preferably, countermeasures known to defend against the known types of missile threats defined within the threat characteristics database 162 are stored within the countermeasure effectiveness database 164. In addition, it is beneficial to have specific data cells located within the threat characteristics database 162, having characteristics of a specific type of missile threat, directly associated with specific data cells located within the countermeasure effectiveness database 164, that have stored therein countermeasures capable of defending an aircraft from the specific type of missile.

An ACS available countermeasures database 166 is located within the storage device 160. The ACS available countermeasure database 166 has stored therein identifications of specific aircrafts 10, 20, 30, 40 that have communicated with the CCMS 102 through their respective ACS 12, 22, 32, 42, and countermeasures presently available on the aircrafts 10, 20, 30, 40.

Data stored within the ACS available countermeasures database 166 changes in real time with communication between an ACS 12, 22, 32, 42 and a CCMS 102, as is further explained in detail herein. It should be noted, however, that standard countermeasures known to be available on aircrafts 10, 20, 30, 40 that will communicate with the CCMS 102 may be stored within the ACS available countermeasure database 166, however, present availability of such standard countermeasures on an aircraft 10, 20, 30, 40 in communication with the CCMS 102 is confirmed prior to the CCMS 102 assigning a countermeasure deployment task to the ACS 12, 22, 32, 42 or any other device. It should also be noted that the ACS available countermeasure database 166 may have stored therein the identifications of numerous aircrafts 10, 20, 30, 40 that have communicated with the CCMS 102, and each of their present individual countermeasure availabilities. By having the identification of each aircraft that has communicated with the CCMS 102 and their individual countermeasure availabilities, the CCMS 102 is capable of determining which aircraft 10, 20, 30, 40 is capable of assisting in deterring a current missile threat, as is explained in detail herein.

Optionally, the storage device 160 may contain a CCMS available countermeasures database 168. The CCMS available countermeasures database 168 has stored therein identifications of local systems having countermeasures that can deter a missile from striking an aircraft 10, 20, 30, 40, where the local systems are not located on the aircrafts 10, 20, 30, 40. As an example, a countermeasure launch pad may be located in the vicinity of the CCMS 102 and capable of communicating with the CCMS 102, thereby making its countermeasures available to the CCMS 102 for deterring a missile from striking an aircraft 10, 20, 30, 40. It should be noted that the CCMS available countermeasures database 168 may not be provided if the only countermeasures available to deter a missile threat are located on aircrafts 10, 20, 30, 40.

Figure 4:
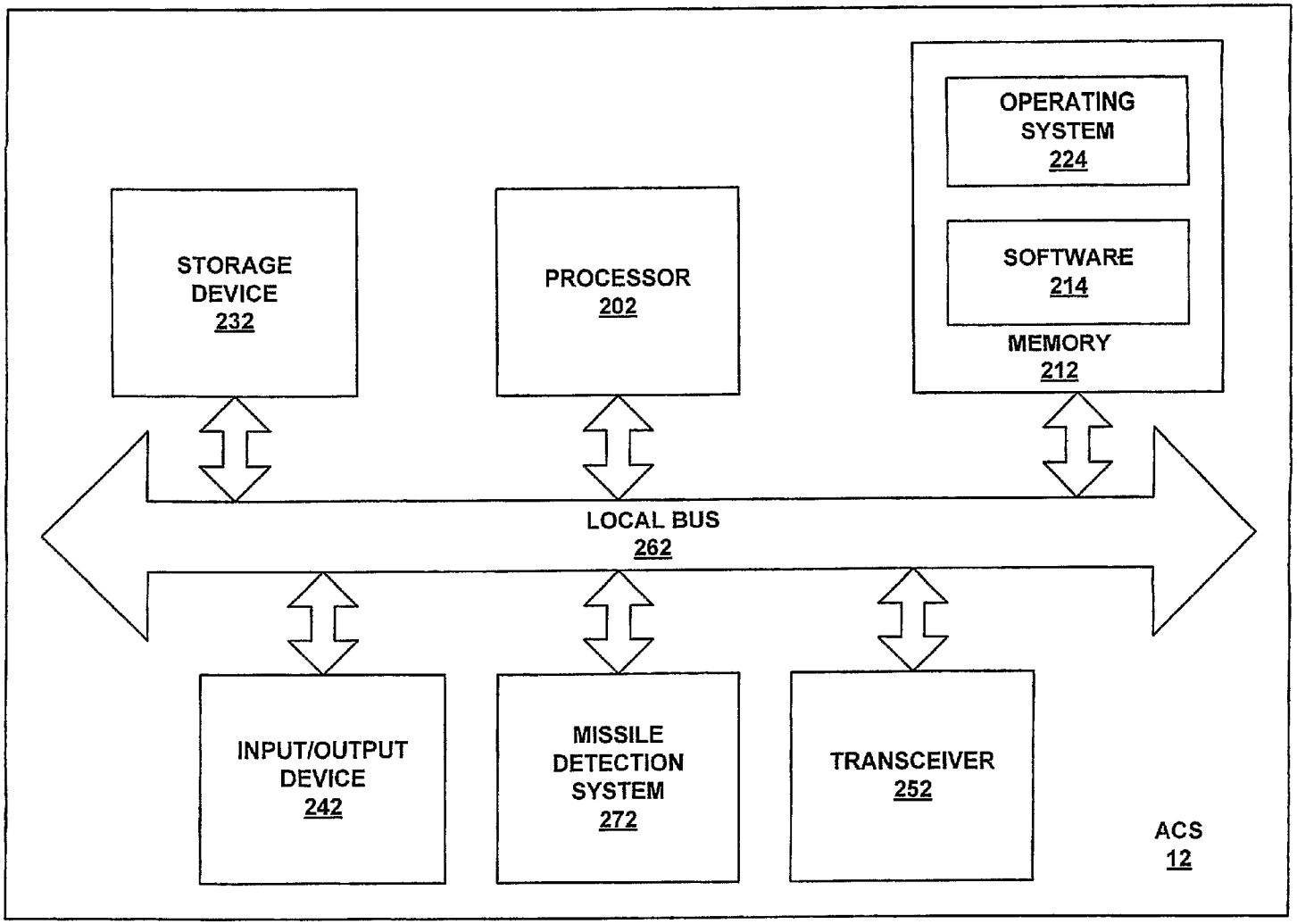
FIG. 4 is a block diagram further illustrating one ACS of FIG. 1.

Each ACS 12, 22, 32, 42 has a structure that is similar to the structure of the CCMS 102 of FIG. 2. FIG. 4 is a block diagram further illustrating one ACS 12 of FIG. 1. It should be noted that each ACS 12, 22, 32, 42 has a similar structure. As is shown by FIG. 4, the ACS 12 contains a processor 202, a memory 212 having software 214 and an operating system 224 therein, a storage device 232, I/O devices 242, a transceiver 252, and a local bus 262. The transceiver 252 is capable of transmitting and receiving signals from and to the CCMS 102. In accordance with the first exemplary embodiment of the invention, the transceiver 252 is capable of high speed, high bandwidth data communication with the CCMS 102. Each device located within the ACS 12 works in a manner similar to that of the CCMS 102. Differences between similar devices located within the ACS 12 and the CCMS 102 include functionality defined by the software 214, as defined hereafter, and data stored within the ACS storage device 232, as defined hereafter.

The ACS 12 also contains a missile detection system 272 that is capable of detecting a missile threat prior to infliction of damage by the missile. The missile detection system 272 may be one of many different missile detection systems known to those having ordinary skill in the art, for example, but not limited to, the AN/ALQ-212(V) ATIRCMWS, the BAE Counter MANPADS system or others). Preferably, the missile detection system 272 is capable of determining certain characteristics of the missile threat. Examples of such characteristics of the missile threat may include, but are not limited to, missile plume intensity and location of the missile threat in comparison to the aircraft 10 (e.g., vector to threat including azimuth, elevation, range, and time). Of course, other characteristics of the missile threat may be determined by the missile detection system 272.

The storage device 232 located within the ACS 12 has stored therein identification of countermeasures presently available on the aircraft 10 that are capable of being deployed by the aircraft 10 having the ACS 12 therein. This identification is used by the CCMS 102 in deterring a detected missile threat prior to missile detonation, as is explained in detail herein. An identification of the aircraft 10 is also stored within the storage device 232, where the identification of the aircraft 10 is capable of being used by the CCMS 102 to determine a source of a transmission received by the CCMS 102.

Depending on the type of missile detection system 272 provided within the ACS 12, when the missile detection system 272 detects a missile threat, certain characteristics of the missile threat, the identification and characteristics of the aircraft 10 (e.g., roll, horizontal elevation, azimuth northing, and time), and countermeasure availability on the aircraft 10 are immediately transmitted from the ACS 12 to the CCMS 102 via the transceiver 252. The transmission from the ACS 12 to the CCMS 102 and use of information within the transmission is described in further detail herein.

Figure 5:
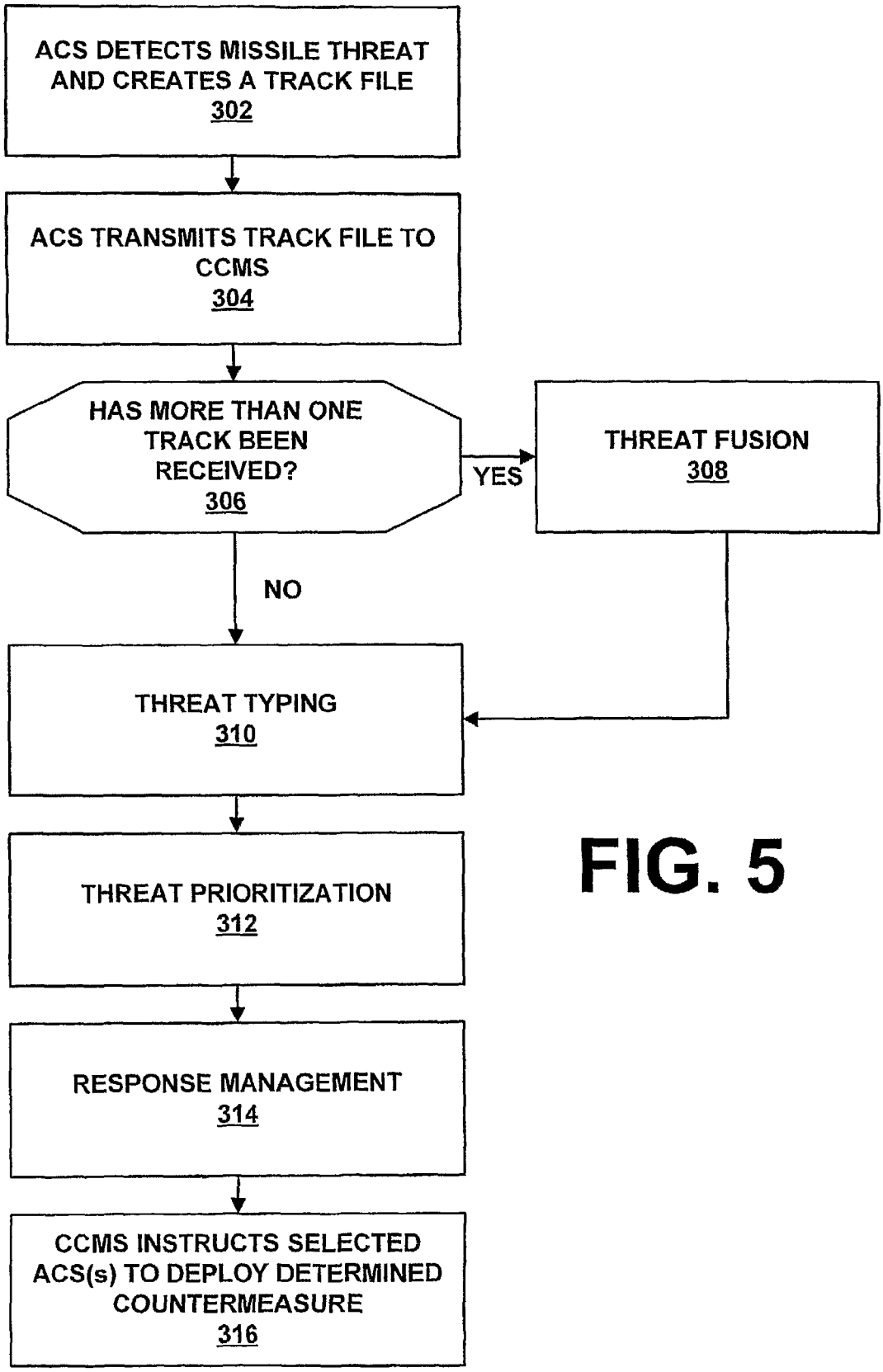
FIG. 5 is a flow chart illustrating steps taken by the present cooperative countermeasure network in response to detection of a missile threat.

FIG. 5 is a flowchart 300 illustrating steps taken by the present cooperative countermeasure network in response to detection of a missile threat. It should be noted that any process descriptions or blocks in flowcharts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

As is shown by block 302, an ACS 12, 22, 32, 42 detects a missile threat and creates a track file. The missile is detected by the missile detection system 272. Preferably, the missile detection system 272 determines information about the missile threat such as, but not limited to, missile plume intensity and location of the missile threat in comparison to the aircraft 10, 20, 30, 40 (e.g., vector to threat including azimuth, elevation, range, and time). Of course, other characteristics of the missile threat may be determined during detection of the missile threat.

The created track file contains the determined missile threat information, identification of the aircraft 10, 20, 30, 40 that detected the missile threat, characteristics of the aircraft 10, 20, 30, 40 such as, but not limited to, aircraft; roll, pitch, and yaw, target; horizontal elevation, azimuth northing and time, and present countermeasure availability on the aircraft 10, 20, 30, 40. Of course other characteristics of the aircraft 10, 20, 30, 40 may also be incorporated into the track file.

The track file is then transmitted from the ACS 12, 22, 32, 42 to the CCMS 102 (block 304). When the track file is received by the CCMS 102 the identification of the aircraft 10, 20, 30, 40 that detected the missile threat and its present countermeasure availability is stored within the ACS available countermeasures database 166. In addition, the determined missile threat information is also stored within the threat characteristics database 162.

As is shown by block 306, a determination is made as to whether more than one track file has been received by the CCMS 102, where each track file is received from a different ACS 12, 22, 32, 42. If more than one track file has been received the tracks are fused (block 308), resulting in comparison of characteristics of the missile threat. During fusion of the track files, information from the track files is combined to provide a detailed description of the missile threat. Specifically, the plume intensities and locations of the missile threat are combined and compared to determine if there is a single missile of concern or multiple missiles. As an example, information describing location of the missile threat may be received from three different ACSs 12, 22, 32, each of which has detected a missile threat. However, after fusing the track files it may be discovered that there are two missiles of concern due to two different detected plume intensities, and comparison of vector to threats, elevations, ranges, and times of the missile threat.

As is shown by block 310, threat typing is then performed to determine the type of missile threat and confidence in the determined threat type from the fused tracks. A known algorithmic theory may be used to determine the type of missile threat and confidence that the missile threat is authentic. As an example, a Bayesian theory, such as the Dempster-Shafer decision theory, may be used to analyze the fused threat track characteristics with false alarm characteristics and known false alarm locations, thereby deriving a type of missile threat and a confidence that the derived type of missile threat is correct. Since one having ordinary skill in the art would know how to use the Dempster-Shafer decision theory, a detailed description of the theory and its use is not provided herein. Of course, other known algorithmic theories may be used to derive a type of missile threat and a confidence that the derived type of missile threat is correct. It should be noted that if there is not more than one tract file being received, threat typing as described above is performed.

As is shown by block 312, when results of threat typing show that a derived threat is authentic, the derived missile threats are prioritized so that the missile most dangerous to a target aircraft is deterred from hitting its target first. Prioritization of the missile threats is performed by searching for each derived missile threat within the threat characteristics database 162. As is mentioned above, the threat characteristics database 162 has stored therein a prioritization rating associated with each missile threat. Therefore, when a derived missile threat is found within the threat characteristics database 162, the associated prioritization rating is determined.

Optionally, when results of threat typing show that the derived threat is authentic, the CCMS 102 may also alert the department of homeland security and/or air traffic control to give notice of the missile threat. Of course other authorities may also be notified of the missile threat so as to ensure that proper actions are taken immediately. In addition, with authenticity of the missile threat assured, reviewing the vector to threat, elevation, range, and time of the missile threat from each ACS 12, 22, 32, 42 may provide a location of the source of the missile threat.

Response management is then performed to address the derived missile threat (block 314). During response management, a countermeasure capable of deterring the derived missile threat is sought within the countermeasure effectiveness database 164. Specifically, the derived missile threat is searched for within the countermeasure effectiveness database 164 to determine what countermeasures are capable of deterring the determined missile threat. During response management, the determined countermeasures are then sought within the ACS available countermeasures database 166 to determine which aircrafts 10, 20, 30, 40 have the determined countermeasures readily available for deployment.

In accordance with an alternative embodiment of the invention, the CCMS available countermeasures database 168 may be searched during response management to determine if any local systems have the determined countermeasures readily available for deployment. As has been mentioned above, such local systems may include a launch pad located local to the CCMS 102 that is capable of launching countermeasures.

As is shown by block 316, the CCMS 102 then transmits a request to a single ACS 12, 22, 32, 42 that is best equipped to deploy the determined countermeasures for purposes of deterring the missile. In addition, if there are multiple missiles launched, the CCMS 102 may transmit different requests to different ACSs 12, 22, 32, 42 that are best equipped to deploy the determined countermeasures. It should be noted, however, that when multiple ACSs are instructed to deploy countermeasures, the decision to use the multiple ACSs takes into consideration that ACSs having a small distance between them may cause interference. Therefore, the CCMS 102 causes selected ACSs that are close together to coordinate deployment of countermeasures to ensure lack of interference.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A system for countering an airborne threat to an aircraft, comprising:

at least one aircraft having an airborne countermeasures system (ACS) capable of controlling deployment of countermeasures located on said aircraft; and a central countermeasures management system (CCMS) capable of communicating with said ACS to control said ACS in deployment of said countermeasures located on said aircraft, wherein said aircraft is one of a series of aircrafts, each aircraft of said series of aircrafts having a separate ACS thereon, wherein each separate ACS is capable of controlling deployment of countermeasures located on an aircraft within said series of aircrafts on which the separate ACS is located, and wherein said CCMS is capable of communicating with each separate ACS in response to said airborne threat, to control deployment of said countermeasures, and wherein said CCMS has a storage device therein having a description of countermeasures presently available by each aircraft within said series of aircrafts that has communicated with said CCMS.

2. A method of countering an airborne threat to an aircraft, comprising the steps of:

receiving threat information about said airborne threat from a remote source;

receiving source information about said remote source;

determining a type of airborne threat from said received threat information and said received source information;

selecting a countermeasure that is presently available by said remote source, wherein said countermeasure is capable of deterring said airborne threat from inflicting damage to said aircraft; and instructing said remote source to deploy said selected countermeasure that is presently available.

3. The method of claim 2, wherein said information about said airborne threat is selected from the group consisting of plume intensity and location of the airborne threat.

4. The method of claim 2, wherein said source information about said remote source is selected from the group consisting of roll, horizontal elevation, azimuth nothing, and time.

5. The method of claim 2, further comprising the step of determining a confidence level that the type of airborne threat determined from said received threat information and said received source information is an actual threat.

6. The method of claim 2, further comprising the step of notifying authorities of said airborne threat.

7. The method of claim 6, further comprising the step of prioritizing countering of each of said threats.

8. A method of countering an airborne threat to an aircraft, comprising the steps of:

receiving threat information about said airborne threat from a remote source;

receiving source information about said remote source;

determining a type of airborne threat from said received threat information and said received source information;

selecting a countermeasure that is presently available by said remote source, wherein said countermeasure is capable of deterring said airborne threat from inflicting damage to said aircraft;

instructing said remote source to deploy said selected countermeasure that is presently available receiving additional information about said airborne threat from multiple sources; and combining and comparing said received information about said airborne threat and said additional information about said airborne threat resulting in fused information.

9. The method of claim 8, wherein said fused information contains a determination as to whether said airborne threat is a single threat or multiple threats.

10. The method of claim 8, further comprising the step of selecting one of said multiple sources to deploy said selected countermeasure that is presently selected.

11. The method of claim 8, further comprising the steps of:

selecting more than one of said multiple sources to deploy said selected countermeasure that is presently selected in accordance with a calculated sequence so as to prevent interference between said countermeasures; and instructing said more than one of said multiple sources to deploy said selected countermeasure that is presently available, in accordance with said calculated sequence.

12. A method of countering an airborne threat to an aircraft, comprising the steps of:

determining threat information about said airborne threat;

transmitting said threat information to a remote device;

transmitting source information to said remote device;

receiving instructions to deploy a countermeasure selected by said remote device, as a result of said steps of determining threat information, transmitting said threat information, and transmitting said source information, wherein said selected countermeasure is presently available; and deploying said selected countermeasure, wherein said threat information and said source information is collectively referred to as a track file.

13. The method of claim 12, wherein said threat information about said airborne threat is selected from the group consisting of plume intensity and location of the airborne threat.

14. The method of claim 12, wherein said source information is selected from the group consisting of roll, horizontal elevation, azimuth nothing, and time.

15. A method of countering an airborne threat to an aircraft, comprising the steps of:

determining threat information about said airborne threat;

transmitting said threat information to a remote device;

transmitting source information to said remote device;

receiving instructions to deploy a countermeasure selected by said remote device, as a result of said steps of determining threat information, transmitting said threat information, and transmitting said source information, wherein said selected countermeasure is presently available; and deploying said selected countermeasure, wherein said threat information and said source information is collectively referred to as a track file;

said steps of determining said threat information, transmitting said threat information, and transmitting said source information being performed by multiple sources, resulting in the transmission of multiple track files;

at least two of said multiple sources receiving instructions to deploy selected countermeasure in accordance with a calculated sequence so as to prevent interference between said countermeasures; and deploying said selected countermeasures in accordance with said calculated sequence.

16. A system for countering an airborne threat to an aircraft, comprising:

at least one aircraft having an airborne countermeasures system (ACS) capable of controlling deployment of countermeasures located on said aircraft; and a central countermeasures management system (CCMS) capable of communicating with said ACS to control said ACS in deployment of said countermeasures located on said aircraft, further comprising instructions transmitted by said CCMS to deploy said countermeasures in accordance with a calculated sequence thereby preventing interference between said countermeasures.

* * * * *